US010464126B2

(12) United States Patent
Du et al.

(10) Patent No.: US 10,464,126 B2
(45) Date of Patent: Nov. 5, 2019

(54) PRESSURE CONTROL SYSTEM AND MEANS FOR PRESSURE POURING OF CAST STEEL WHEELS

(71) Applicant: Amsted Rail Company, Inc., Chicago, IL (US)

(72) Inventors: Zhongxian Du, Xinyang (CN); Hongwei Ma, Xinyang (CN); James Harold Strickland, Chicago, IL (US); Sijin Zhang, Xinyang (CN); Chengqun Yan, Xinyang (CN); Jianfei Sun, Harbin (CN); Fuyang Cao, Harbin (CN); Hongjun Chen, Harbin (CN)

(73) Assignee: Amsted Rail Company, Inc., Chicago, IL (US)

( * ) Notice: Subject to any disclaimer, the term of this patent is extended or adjusted under 35 U.S.C. 154(b) by 399 days.

(21) Appl. No.: 15/407,013

(22) Filed: Jan. 16, 2017

(65) Prior Publication Data

US 2017/0266720 A1 Sep. 21, 2017

(30) Foreign Application Priority Data

Jan. 10, 2016 (CN) ..... 2016 1 0019713

(51) Int. Cl.
*B22D 17/32* (2006.01)
*B22D 17/20* (2006.01)

(52) U.S. Cl.
CPC ..... *B22D 17/32* (2013.01); *B22D 17/2015* (2013.01)

(58) Field of Classification Search
CPC ..... B22D 17/20; B22D 17/2015; B22D 17/32
(Continued)

(56) References Cited

U.S. PATENT DOCUMENTS 4,291,575 A * 9/1981 Frissora ..... G01F 23/162 164/449.1
4,449,568 A * 5/1984 Narasimham ..... B22D 11/005 164/423

FOREIGN PATENT DOCUMENTS

CN 101 786 152 A 7/2010
CN 201 684 915 U 12/2010

OTHER PUBLICATIONS

Ball valve—Wikipedia, the free encyclopedia [retrieved on Dec. 7, 2017], Retrieved from Internet <URL: https://web.archive.org/web/20090124142243/https://en.wikipedia.org/wiki/Ball_valve https://protect-us_mimecast.com/s/g8h5C2kgx2Cpk20PhnlcK6.
(Continued)

*Primary Examiner* — Kevin P Kerns
(74) *Attorney, Agent, or Firm* — Harness, Dickey & Pierce, P.L.C.

(57) ABSTRACT

A pressure control system and means for pressure pouring of cast steel wheels, including a control system and a main gas circuit. The control system includes an upper computer, a PLC unit, a sensor, an operation box and an electronic valve. The upper computer is connected via a signal line with the PLC unit which is connected with each of the sensor, the operation box and the electronic valve. The sensor includes an inside-tank pressure sensor and an inside-mold liquid level detecting sensor. The electronic valve includes a quick breaking valve and a servo valve. The main gas circuit includes a gas pressure bag, a ball valve, a pressure reducing valve, a solenoid valve, and a pressure tank. The gas pressure bag, the ball valve, the pressure reducing valve, the solenoid valve and the pressure tank are connected with one another via gas tubes.

3 Claims, 1 Drawing Sheet

Figure 1:
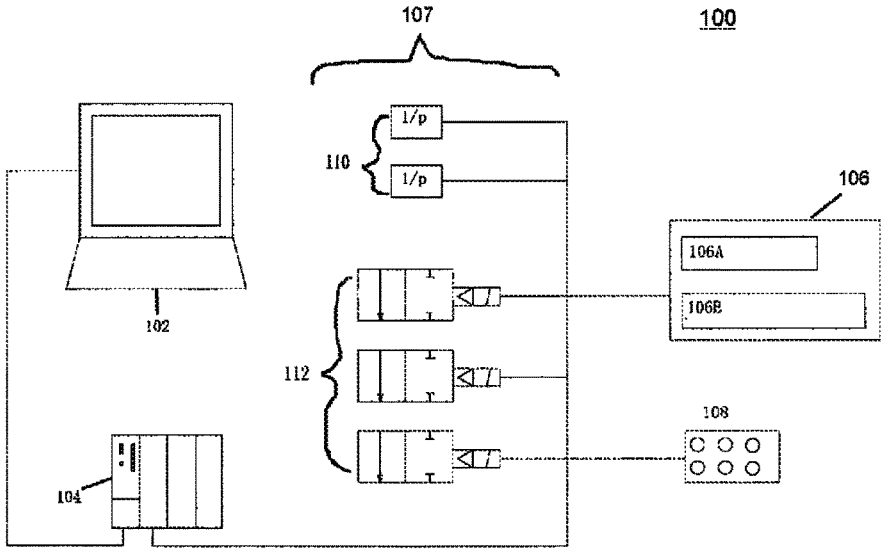

(58) Field of Classification Search
USPC ..... 164/155.1, 155.2, 303, 312, 457
See application file for complete search history.

(56) References Cited

OTHER PUBLICATIONS

Australian Office Action for Application No. 2017200117 dated Oct. 30, 2018 (3 pages).

* cited by examiner

PRESSURE CONTROL SYSTEM AND MEANS FOR PRESSURE POURING OF CAST STEEL WHEELS

CROSS-REFERENCE TO RELATED APPLICATION

This application claims the benefit and priority of Chinese Patent Application Serial No. 201610019713.1 filed Jan. 10, 2016, the entire disclosure of which is incorporated herein by reference.

FIELD

The present invention relates to a technical field of pressure control of cast steel wheels, and specifically to a pressure control system and means for pressure pouring of cast steel wheels.

BACKGROUND

This section provides background information related to the present disclosure which is not necessarily prior art.

Currently in China, the cast steel wheels are all produced by gravity pouring process.

SUMMARY

This section provides a general summary of the disclosure, and is not a comprehensive disclosure of its full scope or all of its features.

In order to improve the processing and the product quality, our company has developed a pressure pouring technology for cast steel wheels. In this technology, a steel ladle containing qualified liquid steel is placed in a pressure vessel which is then be filled with compressed air; the liquid steel under pressure flows into the graphite mold cavity through a pouring passage inserted into the bottom of the steel ladle; after mold filling, the pouring passage is rapidly cut off; the gas is discharged for pressure release; thus the pouring process for the wheels is completed.

The objective of the present invention is to provide a pressure control system and means for pressure pouring of cast steel wheels with respect to the shortcoming(s) of the prior art as mentioned above.

The technical solution of the present invention is provided as follows: a pressure control system and means for pressure pouring of cast steel wheels, comprising a control system and a main gas circuit, wherein the control system comprises an upper computer, a PLC unit, a sensor, an operation box and an electronic valve, the upper computer is connected via a signal line with the PLC unit which is connected with each of the sensor, the operation box and the electronic valve, the sensor comprises an inside-tank pressure sensor and an inside-mold liquid level detecting sensor, and the electronic valve comprises a quick breaking valve and a servo valve; the main gas circuit comprises a gas pressure bag, a ball valve, a pressure reducing valve, a solenoid valve, and a pressure tank, wherein the gas pressure bag, the ball valve, the pressure reducing valve, the solenoid valve and the pressure tank are connected with one another via gas tubes.

Preferably, the quick breaking valve is connected with the ball valve, the ball valve and the pressure reducing valve; the quick breaking valve is connected with the ball valve, the servo valve and the solenoid valve; the quick breaking valve is connected with the ball valve, the servo valve and the solenoid valve; the quick breaking valve is connected with the ball valve, the ball valve, the pressure tank and the solenoid valve.

Preferably, the servo valve is further connected with the ball valve, the solenoid valve and the ball valve; the servo valve is further connected with the ball valve, the solenoid valve and the ball valve.

Compared with the prior art, the present invention may have the following beneficial effects: the pressure control system for pressure pouring of cast steel wheels is safe, reliable and convenient for operation; it can achieve multi-speed mold filling, that is, it can control the flowing speed in different mold filling stages as required; and it can also conveniently select multiple flowing speeds in combination, so as to adapt to the production of different wheel types.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Hereinafter, the present invention will be further described in detail in combination with the embodiments in the figures, which, however, will not constitute any limitation to the present invention.

Figure 2:
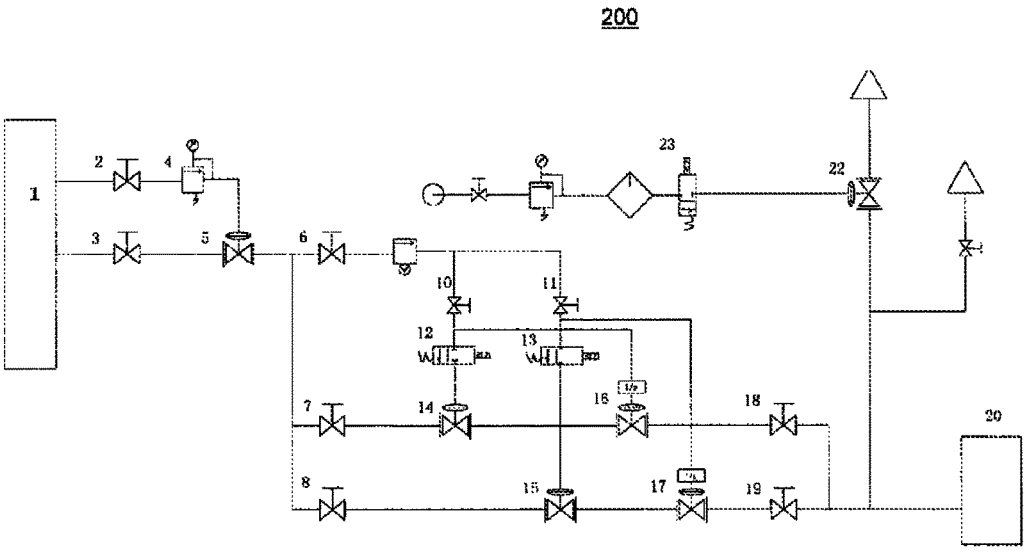

FIG. 1 is a component diagram of a control system according to an embodiment of the present invention; and FIG. 2 is a component diagram of a main gas circuit according to an embodiment of the present invention.

Corresponding reference numerals indicate corresponding parts throughout the several views of the drawings.

DETAILED DESCRIPTION

Example embodiments will now be described more fully with reference to the accompanying drawings.

Referring to FIGS. 1 and 2, the present invention provides a pressure control system and means for pressure pouring of cast steel wheels, comprising a control system 100 (FIG. 1) and a main gas circuit 200 (FIG. 2), wherein the control system 100 comprises a computer 102, a programmable logic controller (PLC) unit 104, a sensor 106, an operation box 108 and an electronic valve 107. The computer 102 is connected via a signal line with the PLC unit 104 which is connected with each of the sensor 106, the operation box 108 and the electronic valve 107. The sensor 106 may comprise an inside-tank pressure sensor 106A and an inside-mold liquid level detecting sensor 106B, and the electronic valve 107 may comprise one or more quick breaking valves 112 and one or more servo valves 110.

As shown in FIG. 2, the main gas circuit 200 comprises a gas pressure bag 1, a ball valve (2), a pressure reducing valve (4), a solenoid valve (12), and a pressure tank 20, wherein the gas pressure bag 1, the ball valve (2), the pressure reducing valve (4), the solenoid valve (12) and the pressure tank 20 are connected with one another via gas tubes. The quick breaking valve 5 is connected with the ball valve 3, the ball valve 6 and the pressure reducing valve 4; the quick breaking valve 14 is connected with the ball valve 7, the servo valve 16 and the solenoid valve 12; the quick breaking valve 15 is connected with the ball valve 8, the servo valve 17 and the solenoid valve 13; the quick breaking valve 22 is connected with the ball valve 18, the ball valve 19, the pressure tank and the solenoid valve 23. The servo valve 16 is further connected with the ball valve 10, the solenoid valve 12 and the ball valve 18; the servo valve 17 is further connected with the ball valve 11, the solenoid valve 13 and the ball valve 19. The one or more quick breaking valves in FIGS. 1 and 2 may also be referred to as one or more valves that regulate, direct or control the flow of a gas by opening and closing. FIG. 2 illustrates one embodiment of the main gas circuit 200, however other embodiments with different arrangements of the components of the main gas circuit 200 are possible. As well, in other embodiments, the main gas circuit 200 may have a different number of the various components shown in FIG. 2. The components shown in FIGS. 1 and 2 may be substituted with variants, equivalent components and components that perform substantially the same function in substantially the same way to obtain substantially the same result.

The working principle of the pressure control system and means for pressure pouring of cast steel wheels of the present invention is provided below. The control system 100 uses the PLC 104 and the computer 102 for control wherein the computer 102 can set up and adjust relevant parameters of the pressure control curves and the PLC 104 can make detection and control to the pouring process by means of programs. The programs may include software programs and software applications running on the computer 102 and/or the PLC 104. According to the shown embodiment, when the system is ready, a starting signal is provided from the operation box 108; then the quick breaking valve 22 closes and the quick breaking valve 14 or the quick breaking valve 15 opens, the servo valves 16 or 17 is also generally fully open, and the system quickly charges gas into the pressure tank 20. The inside-tank pressure sensor 106A sends a pressure signal as feedback to the PLC 104. As well, the inside-mold liquid level detecting sensor 106B sends a signal as feedback to the PLC 104. The PLC 104 controls the opening degrees of the servo valves 16, 17 according to the preset pressure curves so as to control the pressure change inside the tank, and thus achieves the control of the mold filling speed.

The embodiments described as above are example embodiments of the present invention and are set forth only for illustration of the present invention, rather than making limitation to the present invention in any form. Any equivalent embodiment with a partial variation or modification, which does not depart from the technical feature contents of the present invention, made by those skilled in the art based on the technical contents disclosed in the present invention and without departing from the scope of the technical features as provided in the present invention, will fall within the scope of the technical features of the present invention.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A pressure control system and means for pressure pouring of cast steel wheels, comprising a control system and a main gas circuit, wherein the control system includes a computer, a PLC unit, a sensor, an operation box and an electronic valve, the computer is connected via a signal line with the PLC unit which is connected with each of the sensor, the operation box and the electronic valve, the sensor includes an inside-tank pressure sensor and an inside-mold liquid level detecting sensor, and the electronic valve includes at least one quick breaking valve and at least one servo valve;

the main gas circuit includes a gas pressure bag, at least one ball valve, at least one pressure reducing valve, at least one solenoid valve, and a pressure tank, wherein the gas pressure bag, the at least one ball valve, the at least one pressure reducing valve, the at least one solenoid valve and the pressure tank are connected with one another via gas tubes.

2. The pressure control system and means for pressure pouring of cast steel wheels according to claim 1, wherein the at least one quick breaking valve includes first, second, third and fourth quick breaking valves, the at least one ball valve includes first, second, third, fourth, fifth and sixth ball valves, and the at least one servo valve includes first and second servo valves; and the at least one solenoid valve includes first, second and third solenoid valves; and wherein the first quick breaking valve is connected with the first ball valve the second ball valve and the pressure reducing valve, the second quick breaking valve is connected with the third ball valve, the first servo valve and the first solenoid valve, the third quick breaking valve is connected with the fourth ball valve, the second servo valve and the second solenoid valve, and the fourth quick breaking valve is connected with the fifth ball valve, the sixth ball valve, the pressure tank and the third solenoid valve.

3. The pressure control system and means for pressure pouring of cast steel wheels according to claim 1, wherein the first servo valve is further connected with a seventh ball valve, the first solenoid valve and the fifth ball valve, the second servo valve is further connected with an eighth ball valve, the second solenoid valve and the sixth ball valve.

* * * * *